US007246983B2

(12) United States Patent
Zahn et al.

(10) Patent No.: US 7,246,983 B2
(45) Date of Patent: Jul. 24, 2007

(54) PIPE RACKING SYSTEM

(75) Inventors: Baldwin E. Zahn, Houston, TX (US); Mark J. Fillip, Sugar Land, TX (US); Ryllee Tab Tettleton, Tomball, TX (US); Tom Bui, Houston, TX (US)

(73) Assignee: National-Oilwell, L.P., Houston, TX (US)

( * ) Notice: Subject to any disclaimer, the term of this patent is extended or adjusted under 35 U.S.C. 154(b) by 0 days.

(21) Appl. No.: 11/231,712

(22) Filed: Sep. 21, 2005

(65) Prior Publication Data

US 2006/0104747 A1 May 18, 2006

Related U.S. Application Data

(60) Provisional application No. 60/612,026, filed on Sep. 22, 2004.

(51) Int. Cl.
*E21B 19/00* (2006.01)
*A01G 23/02* (2006.01)

(52) U.S. Cl. ..... 414/22.65; 414/23

(58) Field of Classification Search ..... 414/22.63, 414/22.65, 22.68, 22.51, 22.71, 626, 695, 414/589, 917, 745.3, 745.9, 746.3, 746.8, 414/618, 619, 23, 744.1, 744.5, 744.6, 744.7, 414/680, 703; 175/85, 52, 162; 166/77.51; 81/57.35; 173/4; 901/14, 15, 21, 22, 25, 901/37, 39, 1; 211/70.4
See application file for complete search history.

(56) References Cited

U.S. PATENT DOCUMENTS 4,042,123 A * 8/1977 Sheldon et al. ..... 414/22.71
4,610,315 A * 9/1986 Koga et al. ..... 175/85
4,702,663 A * 10/1987 Mischke et al. ..... 414/618
4,765,401 A * 8/1988 Boyadjieff ..... 166/77.53
4,932,537 A * 6/1990 Martinsen ..... 211/70.4
6,298,927 B1 * 10/2001 Back ..... 175/52
6,343,662 B2 * 2/2002 Byrt et al. ..... 173/4
6,591,471 B1 * 7/2003 Hollingsworth et al. . 29/407.09
6,634,443 B1 * 10/2003 Paech et al. ..... 175/85

OTHER PUBLICATIONS

PCT International Search Report and Written Opinion mailed Feb. 22, 2007 in International Patent Application No. PCT/US2005/033864.

* cited by examiner

*Primary Examiner*—Patrick Mackey
(74) *Attorney, Agent, or Firm*—Howrey LLP

(57) ABSTRACT

The pipe racking system is designed to handle drilling tubulars (primarily drill pipe and drill collars) between the racked or setback position and the well center. The racking system can mechanically grasp a stand of pipe, lift the pipe sufficient for free movement, and deliver the pipe to either the setback area for storage or to well center to be added to the drilling string. The purpose of this newly developed system is to move pipe safely and efficiently in the vertical position for drilling operations. Together with the use of its mechanized fingerboard, the system automates the process of handling and storing pipe vertically, thus eliminating the need for a worker at the racking board level. The system is capable of being installed within the masts of smaller rigs and may remain installed in the mast during rig moves thus minimizing any disassembly for rig-down.

38 Claims, 7 Drawing Sheets

PIPE RACKING SYSTEM

CROSS REFERENCE TO RELATED APPLICATION

This application is a non-provisional utility application claiming priority to U.S. Provisional patent application No. 60/612,026, entitled, "Pipe Racking System," by Tom Bui, Mark J. Fillip, Ryllee Tab Tettleton, and Baldwin Zahn, filed Sep. 22, 2004, incorporated by reference herein in its entirety.

BACKGROUND OF THE INVENTION

1. Field of the Invention

The present invention is directed to a pipe racking system for use on a drilling rig. More particularly, the system is designed to move pipe safely and efficiently in the vertical, or near vertical, position for drilling operations.

2. Description of the Related Art

In rotary drilling, a pipe string is positioned into a hole or well and then rotated to drill down into the earth. As the depth of the well increases, the pipe string needs to be lengthened. The pipe string is lengthened by the addition of a section of pipe to the surface end. In order to reach the depths where oil is located, a rig must have a sufficient amount of pipe on hand to be connected to the pipe string. In order to conserve space, the pipe stands are often stored vertically in a rack located relatively close to the pipe stand at the well center. The process of drilling requires both the storage of a quantity of pipe as well as the movement of the pipe between the storage location and the well center.

One way of moving pipe between the two locations is utilizing a worker called a derrick man. The derrick man usually works on a platform located above the drill floor and to the side of the pipe string. The location of the platform enables the derrick man to be able to handle the upper end of the pipe stand, whether it is connected to the pipe string at the well center or located in a storage rack. This method of moving pipe can be slow and also can be rather dangerous for the derrick man.

The invention of the present disclosure is directed to overcoming, or at least reducing the effects of, one or more issues set forth above.

SUMMARY OF THE INVENTION

The invention of the present disclosure is directed to a pipe racking system that enables the safe and efficient movement of pipe between a well center and a storage rack. Together with the use of its mechanized fingerboard, the system mechanizes the process of handling and storing drill pipe and/or drill collars vertically, thus eliminating the need for a worker at the racking board level. This results in reduced risk of injury and much safer practices for pipe handling. While adaptable for various operating environments, the pipe racking system is particularly well suited for land-based drilling rigs.

The pipe racking system is designed to handle drilling tubulars (primarily drill pipe and drill collars) between the racked or setback position and well center. These operations take place within the confines of the mast and drillfloor area while the pipe is vertical. The racking system can mechanically grasp a stand of pipe, lift the pipe sufficiently for free movement, and deliver the pipe to either the setback area for storage or to well center to be added to the drill string.

A preferred embodiment of the system consists of: a) a y-axis travel dolly secured to the mast that straddles a clear space allowing for top drive movement; b) a x-axis carriage to reach and move the pipe; c) a vertical lift column to lift and rotate the pipe; d) a pair of pipe grabs capable of securely gripping and stabilizing the pipe; e) a mating fingerboard with mechanized finger locking system to secure racked pipe in place; and f) an associated control system operated from the drill floor level.

The features of a preferred embodiment of the system include:

1. Capable of remaining installed in the mast during rig moves thus minimizing any disassembly for rig-down;
2. Works in conjunction with a Top Drive or with kelly drilling;
3. Eliminates the need for personnel working above the drill floor at the racking board level;
4. Moves vertical tubulars in a stabilized and controlled manner;
5. Capable of being installed within the masts of smaller, relatively congested land rigs; and
6. Compliments and enhances the efficiency of other automated drilling systems such as the Iron Roughneck, Top Drive, and Power Slips.

One embodiment of the present disclosure is a pipe racking system for use on a rig comprising a dolly attached to a mast of the rig, wherein the dolly is adapted to travel along the mast. The embodiment further includes a bridge hingedly connected to the dolly and a carriage adapted to travel along the bridge. Additionally, the embodiment includes a vertical lift column attached to the carriage that is adapted to raise and lower in relation to the carriage. A boom may be rotatably connected to the vertical lift column and at least one grip adapted to hold at least one pipe stand may be attached to the boom. A fingerboard adapted to hold at least one pipe stand may be attachable to the rig. For example, the fingerboard may include rubber liners to hold at least one pipe stand.

In another embodiment, the grip of the boom and the fingerboard may both be adapted to hold at least one drill collar stand. The boom may include a second grip. In one embodiment, at least one grip on the boom may include at least one sensor. The embodiment may include a motor to rotate the boom in relation to the vertical lift column. Additionally, a position sensor may be connected to the boom. One embodiment includes a control system to control the travel of the dolly, the travel of the carriage, the location of the vertical lift column, and the rotation of the boom. The fingerboard may further include a mechanical locking system to secure a pipe.

The bridge may be hingedly connected to the dolly by at least two arms. Means may be provided for moving the dolly along the mast. The means for moving the dolly along the mast may include a hydraulic cylinder, a motor, or a rack and pinion device, for example. Means, such as a rack and pinion device, may be provided for moving the carriage along the bridge. Additionally, the carriage may include a position sensor to determine its location along the bridge. In one embodiment at least one column may be attachable to the mast. The dolly may be adapted to travel along the column attached to the mast.

One embodiment of the present disclosure is a method of moving a pipe stand to a well center. The embodiment may include the steps of storing a pipe stand in a storage rack; grabbing a pipe stand with at least one grip; moving the pipe stand away from the storage rack by moving a carriage along a bridge; rotating the pipe stand towards the well center; moving the pipe stand towards the well center by moving a dolly vertically along a column that may be attached to the mast of a rig; and releasing the at least one grip when the pipe stand is located at the well center. The method may further include the step of lifting the pipe stand using a vertical lift column. Another embodiment of the method of moving a pipe stand may include the step of lowering the pipe stand at the well center using the vertical lift column. A hydraulic cylinder may be used to open and close the at least one grip. The method of moving a pipe stand to a well center may further include the step of controlling the movement of the pipe stand at a control panel located on a platform on the rig. The storage rack of the method may be a fingerboard. Additionally, the method may include securing at least one pipe stand in the fingerboard by actuating a locking mechanism between the fingers of the fingerboard where the pipe stand is stored.

Another embodiment of the present disclosure is an apparatus for moving pipe on a rig that includes a boom having at least one grip adapted to hold at least one drilling tubular; means for rotating the boom; means for raising and lowering the boom; a bridge; means for horizontally moving the boom along the bridge; one or more dollies; at least one arm hingedly connected to the bridge, wherein each of the at least one arm is also hingedly connected to one or more dollies; and a means for vertically moving the one or more dollies along a mast of the rig, wherein the movement of the one or more dollies in one direction retracts the at least one arm moving the boom towards a well center and the movement of the one or more dollies in the opposite direction extends the at least one arm moving the boom towards a storage area.

Another embodiment of the apparatus for moving pipe may include a hydraulic cylinder attached to the boom to level the pipe stand held in the boom grip while the boom is being moved. Additionally, the boom may include a hydraulic cylinder used to raise and lower the boom to allow for the delivery and retrieval of a pipe stand to and from the well center.

Additionally, the one or more dollies may travel along at least one column connected to the mast of the rig. At least one support arm may be hingedly connected to the at least one arm and the at least one support arm may also be hingedly connected to the at least one column. The boom may include both a lower grip and an upper grip adapted to hold at least one drilling tubular. Alternatively, the grip may be adapted to hold at least one drill collar. In an alternative embodiment, the apparatus may further comprise a plurality of dollies; a plurality of arms hingedly connected to the bridge, wherein each of the plurality of arms is also hingedly connected to a respective dolly of the plurality of dollies; and a plurality of columns connected to the mast of a rig, wherein each dolly of the plurality of dollies travels along a respective column. The apparatus may further include a plurality of support arms, wherein each support arm is hingedly connected to a respective arm of the plurality of arms and each support arm is also hingedly connected to a respective column of the plurality of columns.

Another embodiment of the present disclosure is a method of moving a pipe stand from a well center to a storage rack. The embodiment may include the steps of grabbing a pipe stand located at a well center with at least one grip; rotating the pipe stand away from the well center towards a storage rack; moving the pipe stand towards the storage rack by moving a dolly vertically along a column; rotating the pipe stand towards the storage rack; moving the pipe stand towards the storage rack by moving a carriage along a bridge; securing the pipe stand within the storage rack; and releasing the at least one grip. The method may further include the step of lifting the pipe stand at the well center using a vertical lift column. The method may include the step of lowering the pipe stand at the storage rack using the vertical lift column. In one embodiment, a hydraulic cylinder may be used to open and close the at least one grip. The column may be attached to the mast of a rig. The method may further include the step of controlling the movement of the pipe stand at a control panel located on a platform on the rig. In one embodiment the storage rack may be a fingerboard. The method may include the step of securing the at least one pipe stand in the fingerboard by actuating a locking mechanism between the fingers of the fingerboard where the pipe stand is stored.

Figure 1:
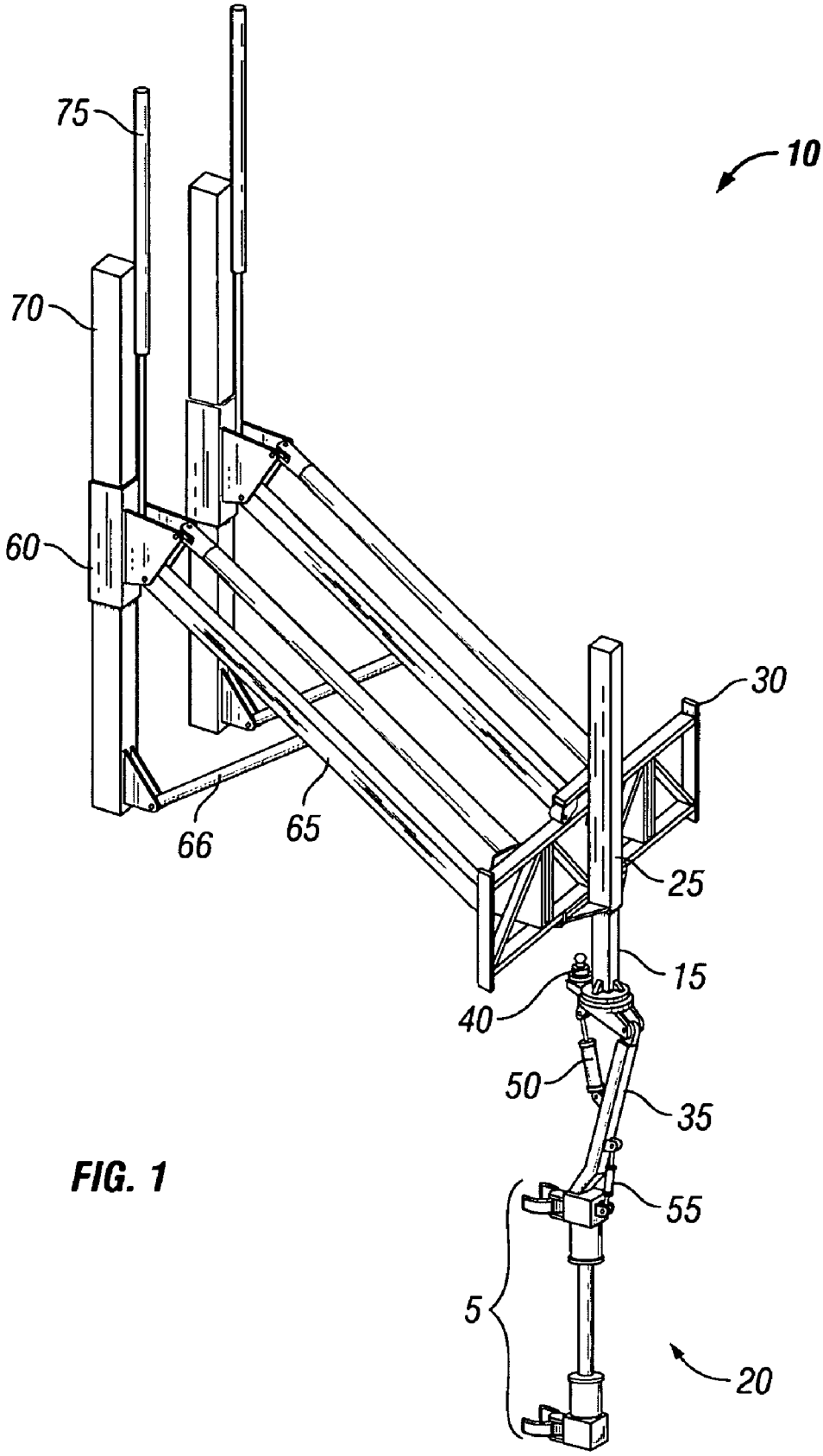
FIG. 1 illustrates the components of one embodiment of the pipe racking system.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the use of designs for a pipe racking system. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows a pipe racking system 10 of the present disclosure designed to eliminate the derrick man and be light enough to remain in the mast 80 (shown in FIGS. 2 and 3) during shipping. The pipe racking system 10 may be mounted to the rear face of the mast 80 above the racking board 85 (shown in FIGS. 2 and 3). In one embodiment, the system 10 has a y-axis travel dolly 60 that travels up and down providing the y-axis (approximately between well center and the fingerboard) movement of the pipe grip 5. The x-axis (in and out of the fingerboard) movement is by an x-axis carriage 25 that travels along a bridge 30 that is supported off of the y-axis arms 65.

In an embodiment of the present disclosure, the pipe racking system 10 may include the following main parts: the lower assembly 20 which includes a dp/dc (drill pipe/drill collar) grip and stabilizer 5, grip rotation 40, boom 35, boom cylinder 50 and leveling cylinder 55; the vertical lift column 15, which raises the lower assembly 20 vertically; the bridge 30 and x-axis carriage 25, which moves the vertical lift column 15 and lower assembly 20 along the bridge 30; the y-axis travel dolly 60 with arms 65, support arms 66, and columns 70, for moving the x-axis carriage 25 and the lower assembly towards and away from the well center.

In one embodiment, the pipe racking system 10 is powered by the drilling rig's hydraulic power unit (HPU). Alternatively, the pipe racking system may use other forms of power such as electrical or pneumatic, or a combination of these as would be recognized by one of ordinary skill in the art having benefit of this disclosure. Additionally, there may be local control panels on the system for interface to an electrical control console.

The embodiment of FIG. 1 may include a dp/dc grip and stabilizer 5, which has a drill pipe/drill collar grip. A hydraulic cylinder, such as boom cylinder 50, may be used to open and close the dp/dc grip while providing enough force to friction grip a triple stand of drill pipe and also support drill collars under the slip recess of the drill collar. A second dp/dc grip may be located below the racking board to stabilize and dampen any swing movement of the pipe stand at the drill floor. The number and location of grips can be varied according to application as would be recognized by one of ordinary skill in the art having benefit of this disclosure. Each dp/dc grip may be equipped with a tubular size sensor and/or a grip closed sensor.

The embodiment of FIG. 1 includes a vertical lift column 15. The vertical lift column 15 may be raised or lowered by a hydraulic motor (not shown). Alternative means could be used to raise and lower the vertical lift column 15 as would be recognized by one of ordinary skill in the art having the benefit of this disclosure. The movement of the vertical lift column 15 is connected to the lower assembly 20. The lower assembly may be used to lift or lower the pipe stand through an arc by itself, or in combination when delivering or receiving pipe at the well center.

As illustrated in FIG. 1, the lower assembly 20 may be rotated by the grip rotation 40. Preferably, the movement of the grip rotation is achieved by using a gear box with hydraulic motor attached. However, alternative means may be used to provide rotation to the lower assembly 20 as would be recognized by one of ordinary skill in the art having the benefit of this disclosure. The grip rotation 40 may be equipped with a position sensor to provide the exact orientation of the column at all times. The position sensor could be any applicable sensor, such as the RT9420 rotational position transducer by Celesco Transducer Products, Inc. of Chatsworth, Calif. for example, as would be apparent to one of ordinary skill in the art having the benefit of this disclosure. Additionally, the embodiment may include hydraulic limit switches for end stop and mechanical rigid end stops to the grip rotation 40 for additional safety.

As shown in FIG. 1, the x-axis carriage 25 travels along the bridge 30 and provides horizontal or x-axis movement to the lower assembly 20. Preferably, the movement of the x-axis carriage 25 is achieved by using a hydraulic motor operating a rack and pinion device (not shown). However, alternative means may be used to movement of the x-axis carriage 25 as would be recognized by one of ordinary skill in the art having the benefit of this disclosure. In some embodiments the x-axis carriage 25 may be equipped with a position sensor to enable the control system to know the exact horizontal position of the grip head at all times. Additionally, position sensors may be used to detect the position of the dp/dc grips relative to the storage rack and/or pipe stands. The means for moving the x-axis carriage 25 may also include hydraulic limit switches for end stop and mechanical rigid end stops as additional safety as would be recognized by one of ordinary skill in the art having the benefit of this disclosure.

Figure 2:
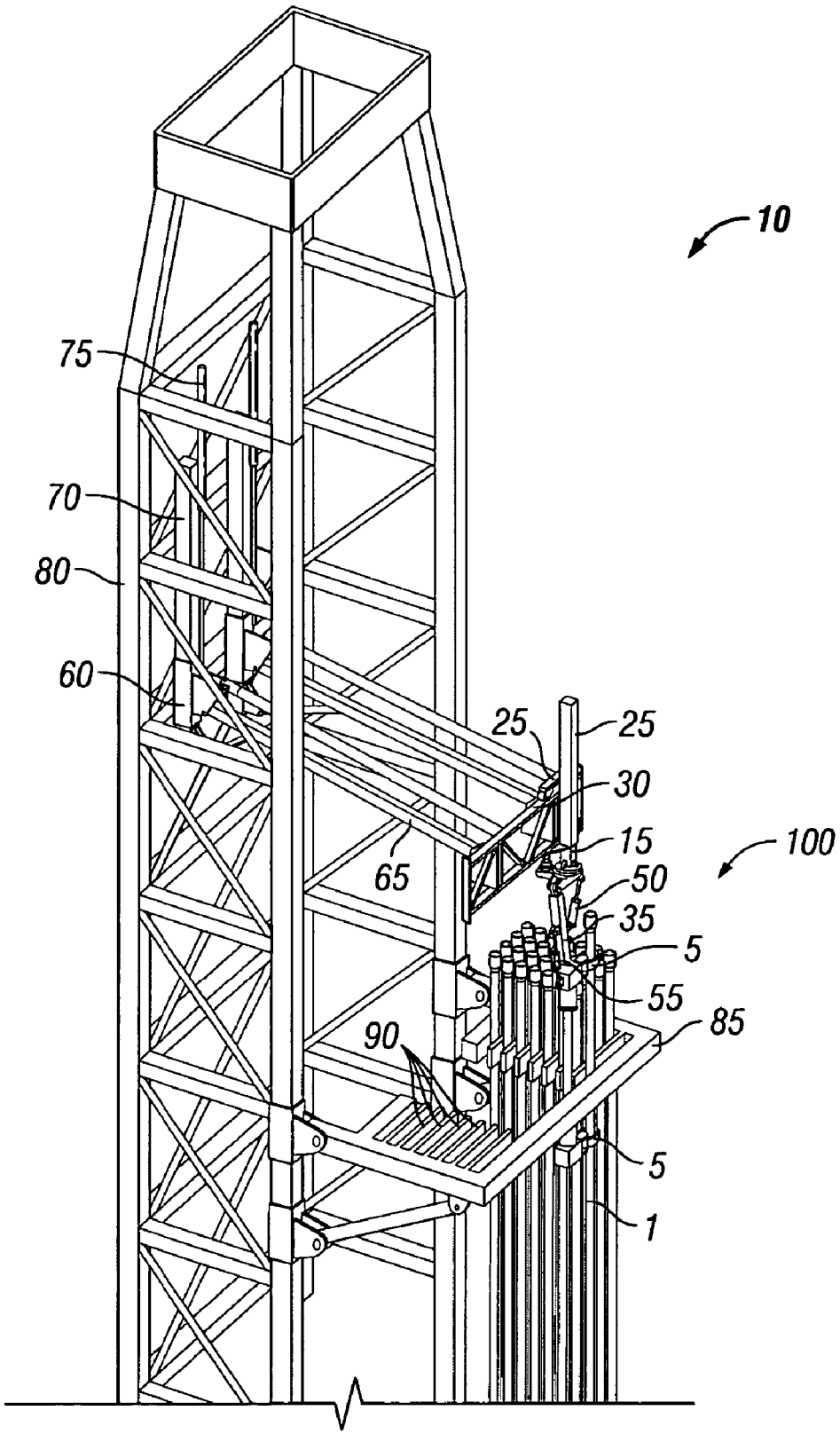
FIG. 2 illustrates one embodiment of the pipe racking system used in conjunction with a conventional Kelly driven drilling rig.
Figure 3:
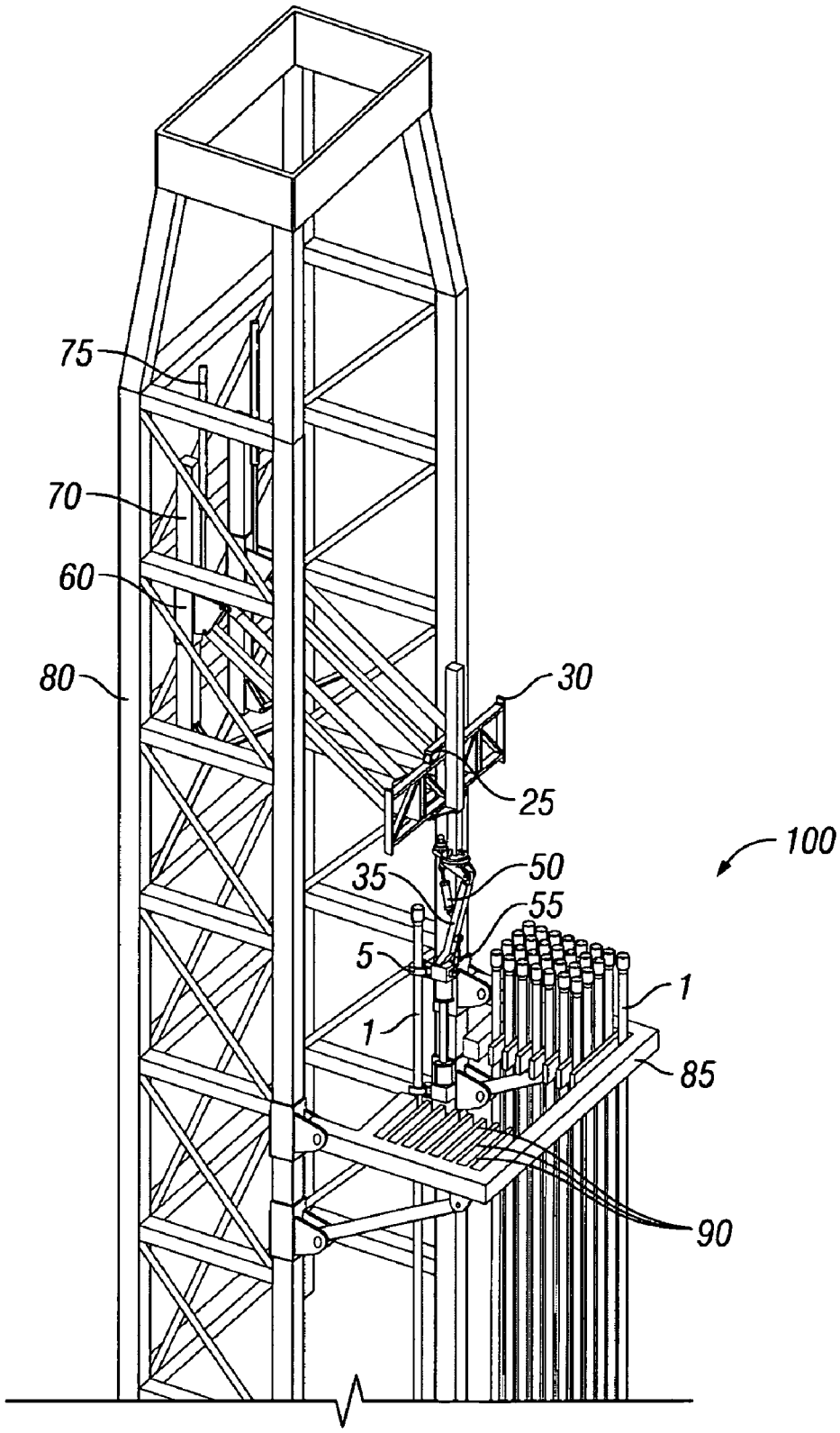
FIG. 3 illustrates the embodiment of the pipe racking system of FIG. 2 with a pipe removed from the fingerboard.

The y-axis travel dolly 60 may include arms 65 and columns 70, as shown in FIG. 1. Preferably, the y-axis travel dolly 60 travels up and down along the columns 70, which may be mounted to the sides or the back of the mast 80 as shown in FIGS. 2 and 3. The up/down movement of the dolly 60 may be provided by a rack and pinion system driven by a hydraulic motor. However, other means, such as a hydraulic cylinder 75 for example, could be used to move the dolly 60 along the columns as would be recognized by one of ordinary skill in the art having the benefit of this disclosure. In some embodiments the pinion system may be driven by a hydraulic motor equipped with a position sensor which enables the control system to know the y-axis position of travel dolly at all times, which could also enable the control system to know the y-axis position of the dp/dc grip and stabilizer 5 at all times.

In the embodiment shown in FIG. 1, the upward movement of the y-axis travel dolly 60 moves the lower assembly 20 towards the well center through a scissor-like action. In one embodiment the movement of the y-axis travel dolly 60 could both move the lower assembly 20 towards the well center while also lowering the lower assembly 20. The arms 65 may be hingedly connected to both the y-axis travel dolly 60 and the bridge 30, which is connected to the lower assembly 20. Additionally, support arms 66 are hingedly connected to a point along the arms and a fixed point located near the bottom of column 70. As the y-axis travel dolly 60 travels up the column 70, the support arms 66 cause the arms 65 to move towards the columns 70 and thus, moving the lower assembly 20 towards the well center. Conversely, as the y-axis dolly travels down columns 70, the arms 65 extend away from the well center. In an alternative embodiment, the downward movement of the y-axis dolly 60 could move the pipe stand 1 towards the well center while the upward movement of the y-axis dolly 60 could move the pipe stand 1 away from the well center.

As shown in FIGS. 2 and 3, the embodiment may include a fingerboard 85 in which the fingers 90 are oriented parallel in a traditional manner with space for a diving board (not pictured) in the center. The diving board is folded out of the way when the pipe racking system 10 is in operation. There may be a main lock (not shown) at the tip of each finger 90. Locks may be based on a pneumatic 90° actuator with spring return to close position. Various securing means, such as a hydraulic latch and rubber liners for example, could be used to secure a pipe within the fingerboard 85 as would be recognized by one of ordinary skill in the art having the benefit of this disclosure. The lock arm may be supported in a cradle on the opposite finger when it is in closed position. Alternatively, the pipe 1 may be held in the fingerboard 85 by friction grip using rubber liners (not shown), which line the length of the fingers 90.

Preferably, hydraulic and electric supplies lines (not picture) for the apparatus may be connected at the fingerboard 85 level. The electric cables and hydraulic hoses may be run in a hanging loop (not shown) along the outside of the x-axis bridge 30. Pneumatic and electric supply to the fingerboard locks may be based on fixed pipe and cable on the fingerboard level.

The embodiment may include an electrical control console. The electrical control console for the operator may be located in a safe area on the platform of the rig. The console may include switches and indicators to allow control from a stationary location. The console may be rated IP54 or better and have lifting lugs for ease of placement.

The pipe racking system 10 is designed to work with automatic elevators and link tilt system typically found on drilling rigs. Additionally, the pipe racking system 10 is designed to work with an Iron Roughneck and/or other typical equipment as would be recognized by one of ordinary skill in the art having benefit of this disclosure.

The pipe racking system provides a process to move tubular stands 1 between the well center and the setback storage area 100. The process of retrieving tubulars 1 from the fingerboard 85 to the well center begins with the grip rotation 40 rotating the lower assembly 20 90° to the right or left depending on the finger board 85 layout. The arms 65 of the y-axis travel dolly 60 are extended along the y-axis to the selected finger 90 by the upward or downward movement of the y-axis travel dolly 60. The x-axis carriage then moves along the bridge 30, thus moving the lower assembly 20 and the dp/dc grips 5 into the finger slot until it reaches a drilling tubular 1. The grips 5 of the lower assembly 20 then close grasping the tubular 1 and then lifts the tubular 1 in the set back area by raising the lower assembly 20 with the vertical lift column 15. In one embodiment, the drill pipe stands 1 are lifted with a friction grip beneath the tool joint of the uppermost joint of the drill pipe and the drill collars are lifted in the slip recess. The x-axis carriage 25 then travels back along the bridge 30 moving the drilling tubular 1 out of the finger slot. The tubular 1 and lower assembly 20 are then rotated 90° by the grip rotation 40 to align with the well center delivery position. The pipe stand 1 is then moved toward well center by raising the y-axis travel dolly 60. The upward movement of the dolly 60 causes the end of the arms 65, which are attached to the bridge 30, to swing towards the well center. The pipe racking system 10 may either set the stand on the drill floor and wait for the drilling rig's hydraulic powered elevator positioned by a link tilt system to latch around the pipe, or deliver the pipe to the well center for the hydraulic powered elevator to capture the pipe. The elevator is then latched to the stand's upper end and the grip of the lower assembly is opened and can return for another stand. The lower end of the stand may be grabbed by the centralize/stabbing device on the iron roughneck or by the drill floor manipulator arm.

Placing pipe retrieved from the drill string into the fingerboards follows the reverse sequence from above. For drill collars, the stand is broken and spun out while the elevator supports the stand and then lifted clear of the box. The link tilt system tilts out to the exchange point and sets the drill collar on the floor. The pipe racking system 10 grips the collar stand 1 and lifts using the vertical lift column 15. The elevators release and return for another stand.

For retrieving drill pipe, the grips of the lower assembly are tilted out to well center to enclose the pipe 1. The grips 5 are then closed taking the pipe 1 from the elevator. The y-axis dolly travels down the columns 70 extending the arms 65 out towards the fingerboard. Once the lower assembly 20 has reached the desired storage slot, the grip head of the lower assembly 20 is rotated 90° to the left or right depending upon where the tubular is to be placed in the fingerboard. Once the lower assembly 20 has been rotated, the x-axis carriage 25 travels on the bridge 30 to deliver the pipe 1 into the proper slot between the fingers 90. The pipe 1 may then be lowered to a desired height by the vertical lift column 15. Once the pipe is secured between the fingers 90, the grips 5 are released. The fingerboard 85 may include pneumatic locks at each finger opening. Alternatively, hydraulic or electric locks or other means may also be employed to secure the pipe stand 1 as would be recognized by one of ordinary skill in the art having the benefit of this disclosure.

An alternative embodiment (not shown) of the disclosure may comprise a single column attached to the mast of a rig. A y-axis travel dolly may be adapted to travel along the column. The dolly may be hingedly connected to a single arm and a support arm, both also being hingedly connected to a bridge. The movement of the dolly along the column may extend or retract the single arm attached to the bridge depending on the direction of movement of the dolly. An x-axis carriage may be adapted to travel along the bridge. A lower assembly may be attached to the x-axis carriage. The lower assembly may comprise a boom, boom cylinder, leveling cylinder, and at least one grip. The number and location of grips may be varied according to application as would be recognized by one of ordinary skill in the art having the benefit of this disclosure. The lower assembly may include a grip rotation, which rotates the boom and at least one grip. The at least one grip may be adapted to securely grip and stabilize a pipe stand. The at least one grip may be opened and closed by a hydraulic cylinder.

FIG. 2 illustrates the pipe racking system 10 in which the lower assembly 20 has been rotated and is retrieving a pipe stand 1 from the fingerboard 85. As shown, the y-axis arms 65 are extended to reach the fingerboard 85 and the x-axis carriage 25 has traveled along the bridge 30 to reach the pipe. The grips 5 have been closed onto the pipe stand 1 and the pipe stand 1 has been lifted out of the fingerboard 85 by the vertical lift column 15. FIG. 3 shows the pipe racking system 10 in which the y-axis dolly 60 has begun to travel up the columns 70. Thus, the y-axis arms have begun to retract towards the columns 70 and the pipe stand 1 being held in the dp/dc grips 5 of the lower assembly 20 is moved towards the well center.

Figure 4:
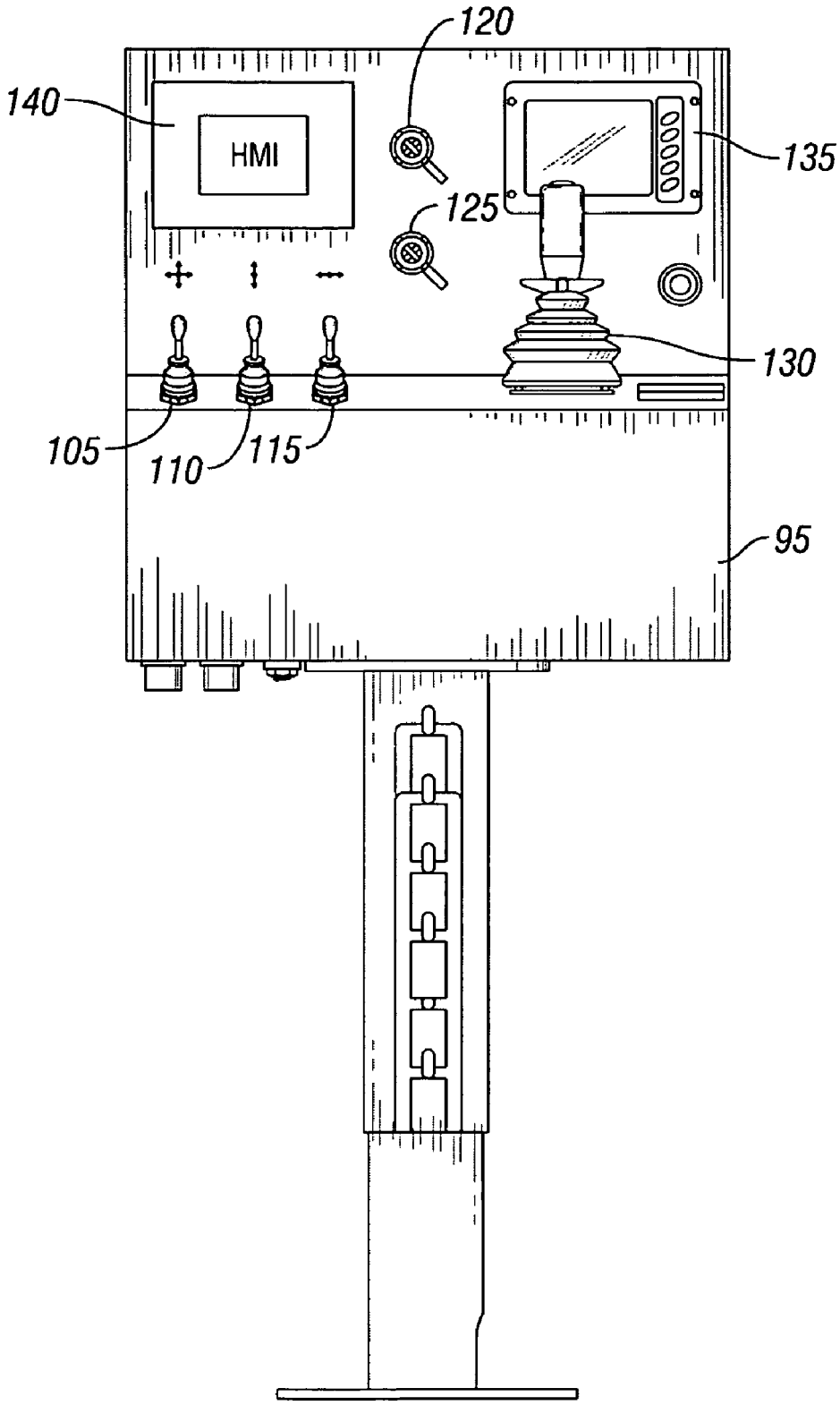
FIG. 4 illustrates a console located on the drill floor on of one embodiment of the present disclosure.

FIG. 4 illustrates one embodiment of an electrical control console 95, which may be located on the drilling floor. The electrical control console 95 includes a joystick 130 that controls the expansion or retraction of the arms 65 by actuating the movement the y-axis travel dolly 60 along the column 70. Additionally, the joystick 130 controls the movement of the x-axis carriage 25 along the bridge 30. The electrical control console 95 may include a toggle 105 that controls height of the lower assembly 20 by actuating the lift column 15 and/or the boom cylinder 50. Additionally, the electrical control console 95 may include a toggle 110 for controlling the rotation of the lower assembly 20 by actuating the grip rotation 40. The electrical control console 95 may include a toggle 115 that controls the angle of the lower assembly by actuating the leveling cylinder 55. In some embodiments, the electrical control console 95 may include a visual feedback monitor 135 as well as a calibration display 140. The electrical control console 95 may also include separate switches 120, 125 to open and close the grips 5 on the lower assembly 20.

Figure 5:
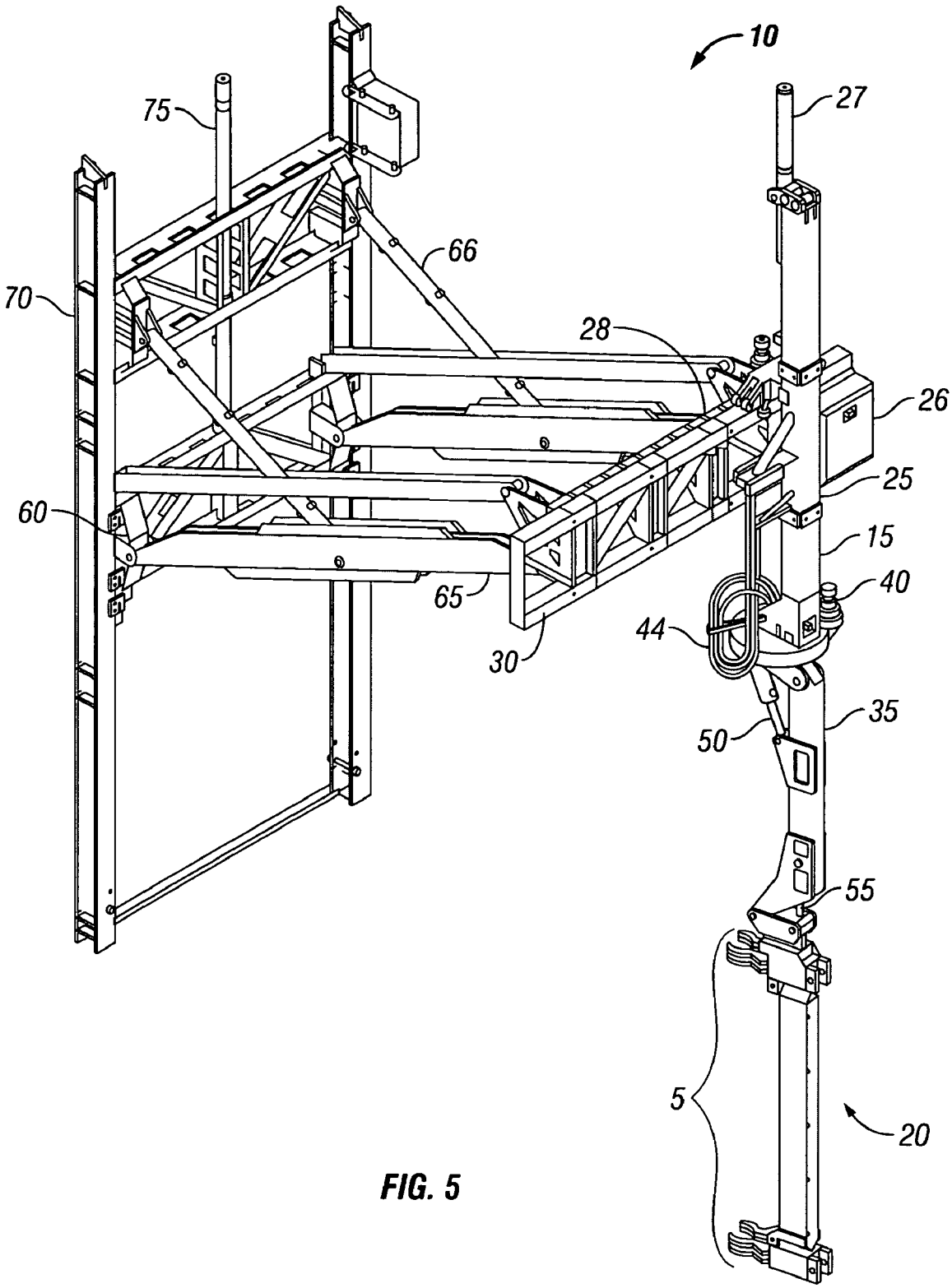
FIG. 5 illustrates one embodiment of the pipe racking system.

FIG. 5 shows an embodiment of the mechanized pipe racking system 10 of the present disclosure designed to eliminate the derrick man and be light enough to remain in the mast 80 (shown in FIGS. 6 and 7) during shipping. The pipe racking system 10 may be mounted to the rear face of the mast 80 above the racking board 85 (shown in FIGS. 2 and 3). In one embodiment, the system 10 has a y-axis travel dolly 60 that travels up and down providing the y-axis (approximately between well center and the fingerboard) movement of the pipe grip 5. The x-axis (in and out of the fingerboard) movement is by an x-axis carriage 25 that travels along a bridge 30 that is supported off of the y-axis arms 65.

Like the embodiment shown in FIG. 1, the pipe racking system 10 may include a lower assembly 20 which includes a dp/dc (drill pipe/drill collar) grip and stabilizer 5, grip rotation 40, boom 35, boom cylinder 50 and leveling cylinder 55; a vertical lift column 15, which raises the lower assembly 20 vertically; a bridge 30 and an x-axis carriage 25, which moves the vertical lift column 15 and the lower assembly 20 along the bridge 30; a y-axis travel dolly 60 with arms 65, support arms 66, and columns 70, for moving the x-axis carriage 25. Additionally, the pipe racking system 10 may include service loops or drag chains 44 as shown in FIG. 5, local control panels 26 as shown in FIG. 5, and an electrical control console 95 as shown in FIG. 4.

In one embodiment, the pipe racking system 10 is powered by the drilling rig's hydraulic power unit (HPU). Alternatively, the pipe racking system may use other forms of power such as electrical or pneumatic, or a combination of these as would be recognized by one of ordinary skill in the art having benefit of this disclosure. The service loops or drag chains 44 may allow the lower assembly to expand, retract, tilt, and/or rotate while the components of the lower assembly 20 still receive electrical power, hydraulic fluid, and/or pneumatic pressure. The pipe racking system may include a local control panel 26 on the system to interface to an electrical control console. The local control panel 26 may be located at various locations on the pipe racking system, like attached to the carriage as shown in FIG. 5, as would be appreciated by one of ordinary skill in the art having the benefit of this disclosure.

The embodiment of FIG. 5 includes a vertical lift column 15. The vertical lift column 15 may be raised or lowered by a cylinder 27 or a hydraulic motor (not shown). Alternative means could be used to raise and lower the vertical lift column 15 as would be recognized by one of ordinary skill in the art having the benefit of this disclosure. The movement of the vertical lift column 15 is connected to the lower assembly 20. The lower assembly may be used to lift or lower the pipe stand through an arc by itself, or in combination when delivering or receiving a pipe stand at the well center.

As shown in FIG. 5, the x-axis carriage 25 travels along the bridge 30 and provides horizontal or x-axis movement to the lower assembly 20. Preferably, the movement of the x-axis carriage 25 is achieved by using a hydraulic motor operating a rack and pinion device 28. However, alternative means may be used to move the x-axis carriage 25 as would be recognized by one of ordinary skill in the art having the benefit of this disclosure. In some embodiments the x-axis carriage 25 may be equipped with a position sensor to enable the control system to know the exact horizontal position of the grip head at all times. Additionally, position sensors may be used to detect the position of the dp/dc grips relative to the storage rack and/or pipe stands. The means for moving the x-axis carriage 25 may also include hydraulic limit switches for end stop and mechanical rigid end stops as additional safety as would be recognized by one of ordinary skill in the art having the benefit of this disclosure.

Figure 6:
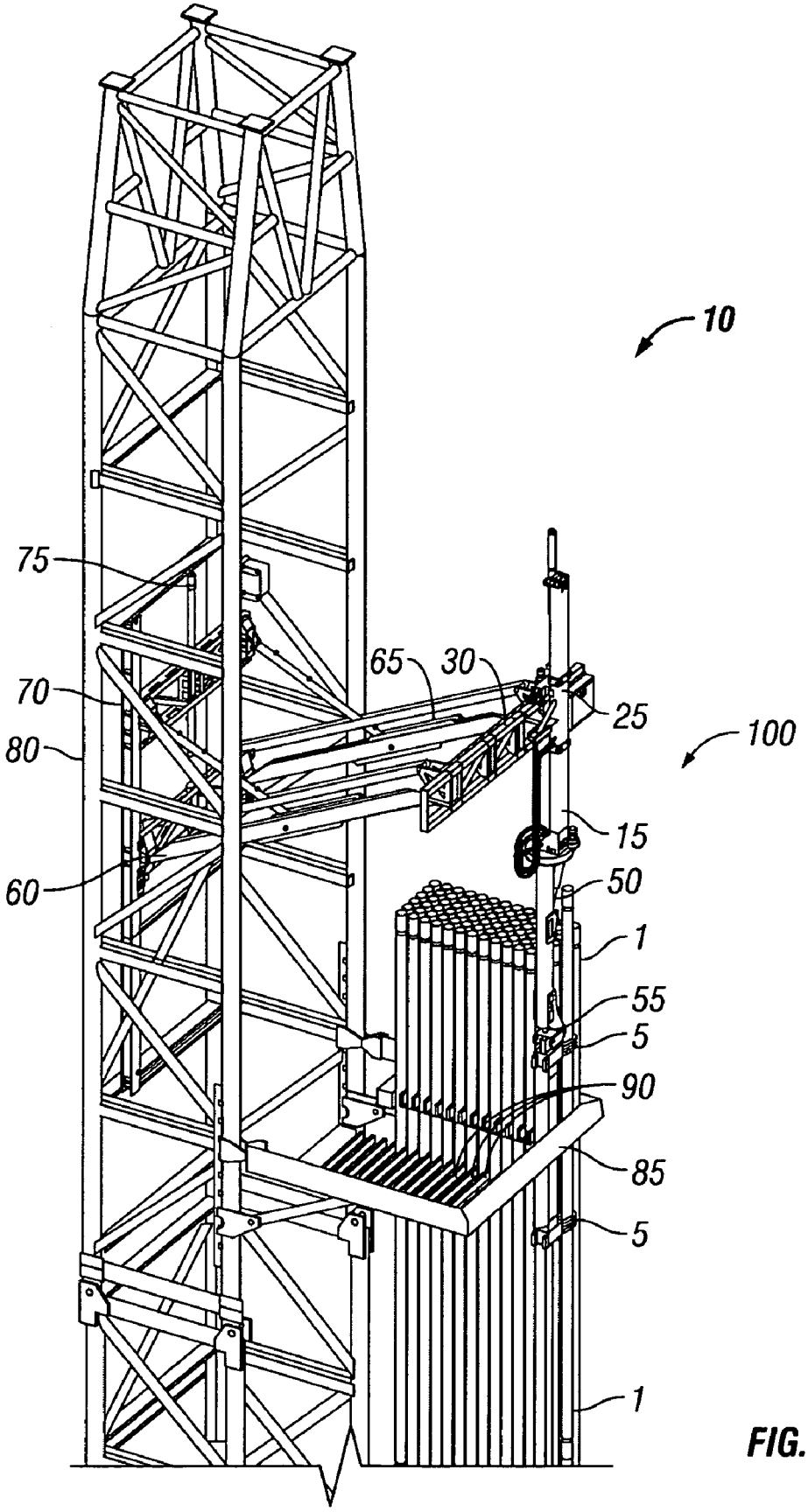
FIG. 6 illustrates the embodiment of FIG. 5 installed on the mast of a rig and the pipe racking system is retrieving a pipe stand from a finger board.
Figure 7:
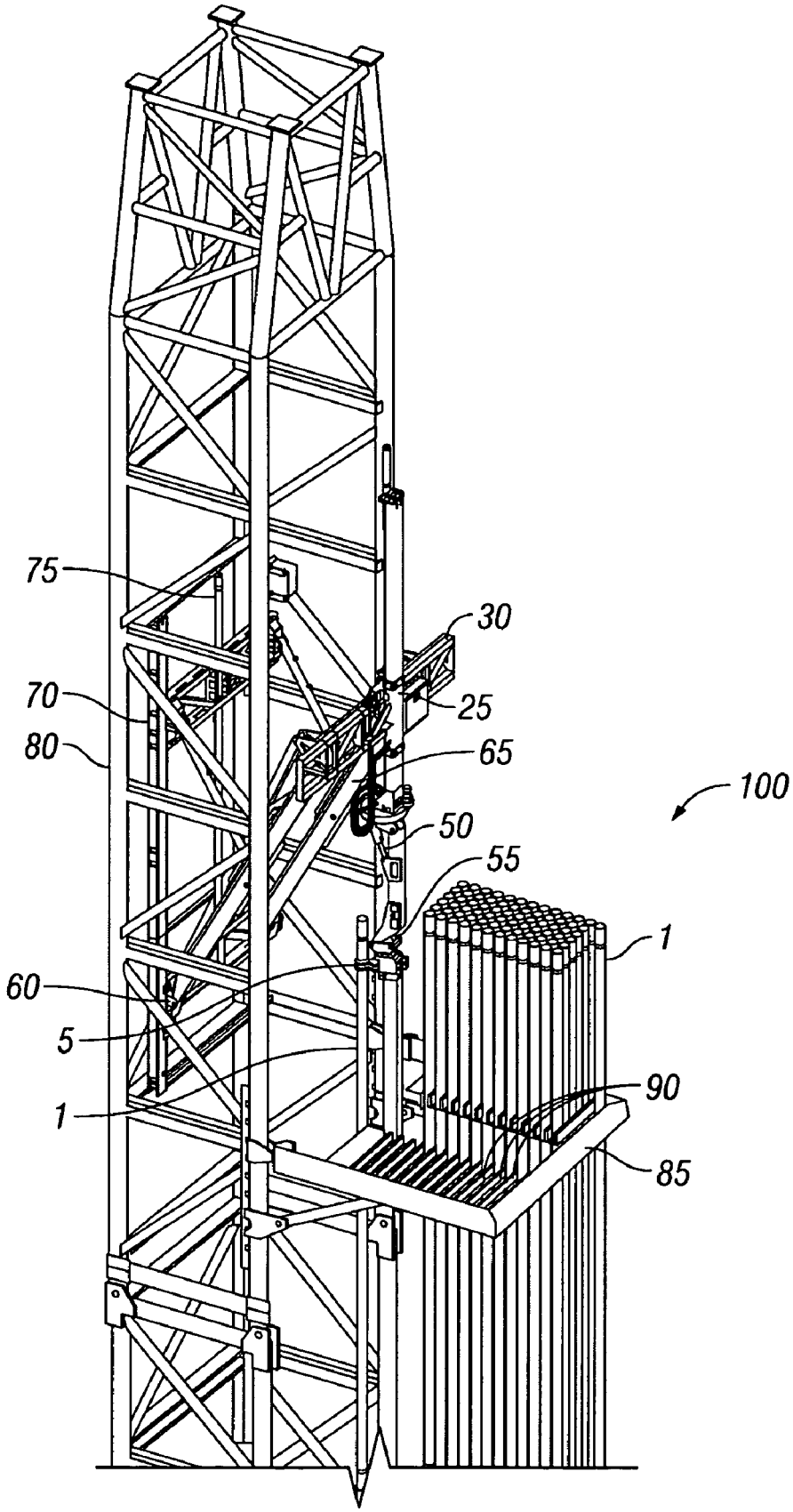
FIG. 7 illustrates the embodiment of FIG. 5 installed on the mast of a rig and the pipe racking system is moving a pipe stand to the well center.

The y-axis travel dolly 60 may include arms 65 and columns 70, as shown in FIG. 5. Preferably, the y-axis travel dolly 60 travels up and down along the columns 70, which may be mounted to the sides or the back of the mast 80 as shown in FIGS. 6 and 7. The up/down movement of the dolly 60 may be provided by a rack and pinion system driven by a hydraulic motor. However, other means, such as a single hydraulic cylinder 75 for example, could be used to move the dolly 60 along the columns as would be recognized by one of ordinary skill in the art having the benefit of this disclosure.

FIG. 6 illustrates the pipe racking system 10 of FIG. 5 installed on the mast 80 of a rig and in which the lower assembly 20 has been rotated and is retrieving a pipe stand 1 from the fingerboard 85. As shown, the y-axis arms 65 are extended to reach the fingerboard 85 and the x-axis carriage 25 has traveled along the bridge 30 to reach the pipe. The grips 5 have been closed onto the pipe stand 1 and the pipe stand 1 has been lifted up from the fingerboard 85 by the vertical lift column 15.

FIG. 7 shows the pipe racking system 10 of FIG. 5 installed on the mast 80 of a rig and in which the x-axis carriage 25 has traveled back to the center of the bridge 30 after retrieving a pipe stand 1 and the lower assembly 20 has been rotated such that the pipe stand 1 is on the well center side of the boom. Additionally, the y-axis dolly 60 has traveled down the columns 70 and thus, the y-axis arms 65 have begun to retract towards the columns 70 and the pipe stand 1 being held in the dp/dc grips 5 of the lower assembly 20 is moved towards the well center.

Although various embodiments have been shown and described, the invention is not so limited and will be understood to include all such modifications and variations as would be apparent to one skilled in the art.

What is claimed is:

1. A pipe racking system for use on a rig comprising:

a dolly attached to a mast of the rig, wherein the dolly is adapted to travel along the mast;

a bridge, wherein the bridge is hingedly connected to the dolly;

a carriage adapted to travel along the bridge;

a vertical lift column attached to the carriage and adapted to raise and lower in relation to the carriage;

a boom rotatably connected to the vertical lift column;

at least one grip attached to the boom, the at least one grip adapted to hold at least one pipe; and a fingerboard attachable to the rig, the fingerboard adapted to hold at least one pipe stand.

2. The pipe racking system of claim 1, wherein the at least one grip and the fingerboard are both adapted to hold at least one drill collar.

3. The pipe racking system of claim 1, the boom further comprising a second grip.

4. The pipe racking system of claim 3, further comprising a motor to rotate the boom in relation to the vertical lift column.

5. The pipe racking system of claim 1, further comprising a control system to control the travel of the dolly, the travel of the carriage, the location of the vertical lift column, and the rotation of the boom.

6. The pipe racking system of claim 1, wherein the fingerboard further comprises a mechanical locking system to secure the at least one pipe.

7. The pipe racking system of claim 1, wherein the bridge is hingedly connected to the dolly by at least two arms.

8. The pipe racking system of claim 1, further comprising means for moving the dolly along the mast.

9. The pipe racking system of claim 8, wherein the means for moving the dolly along the mast comprises at least one hydraulic cylinder.

10. The pipe racking system of claim 8, further comprising means for moving the carriage along the bridge.

11. The pipe racking system of claim 10, wherein the means for moving the carriage along the bridge comprises a rack and pinion device.

12. The pipe racking system of claim 1, further comprising at least one column attachable to the mast.

13. The pipe racking system of claim 12, wherein the dolly is adapted to travel along the at least one column.

14. The method of moving a pipe stand to a well center comprising:

storing a pipe stand in a storage rack;

grabbing a pipe stand with at least one grip;

moving the pipe stand away from the storage rack by moving a carriage along a bridge;

rotating the pipe stand about a vertical axis towards the well center;

moving the pipe stand towards the well center by moving a dolly vertically along a column; and releasing the at least one grip when the pipe stand is located at the well center.

15. The method of claim 14, further comprising the step of lifting the pipe stand using a vertical lift column.

16. The method of claim 15, further comprising the step of lowering the pipe stand at the well center using the vertical lift column.

17. The method of claim 14, wherein a hydraulic cylinder is used open and close the at least one grip.

18. The method of claim 14, wherein the column is attached to a mast of a rig.

19. The method of claim 18, further comprising the step of controlling the movement of the pipe stand at a control panel located on a platform on the rig.

20. The method of claim 14, wherein the storage rack is a fingerboard.

21. The method of claim 20, further comprising securing at least one pipe stand in the fingerboard by actuating a locking mechanism between the fingers of the fingerboard where the pipe stand is stored.

22. An apparatus for moving pipe on a rig comprising:

a boom having at least one grip adapted to hold at least one drilling tubular;

means for rotating the boom;

means for raising and lowering the boom;

a bridge;

means for horizontally moving the boom along the bridge;

one or more dollies;

at least one arm hingedly connected to the bridge, wherein the at least one arm is also hingedly connected to the one or more dollies; and means for vertically moving the one or more dollies along a mast of the rig, wherein the movement of the one or more dollies in one direction retracts the at least one arm moving the boom towards a well center and the movement of the one or more dollies in the opposite direction extends the at least one arm moving the boom towards a storage area.

23. The apparatus of claim 22, further comprising a hydraulic cylinder to level the boom.

24. The apparatus of claim 22, wherein the one or more dollies travels along at least one column connected to the mast of the rig.

25. The apparatus of claim 24, further comprising at least one support arm hingedly connected to the at least one arm and the at least one support arm is also hingedly connected to the at least one column.

26. The apparatus of claim 22, wherein the boom has a lower grip and an upper grip adapted to hold at least one drilling tubular.

27. The apparatus of claim 22, wherein the at least one grip is adapted to hold at least one drill collar.

28. The apparatus of claim 22, further comprising:

a plurality of dollies;

a plurality of arms hingedly connected to the bridge, wherein each of the plurality of arms is also hingedly connected to a respective dolly of the plurality of dollies; and a plurality of columns connected to the mast of a rig, wherein each dolly of the plurality of dollies travels along a respective column.

29. The apparatus of claim 28, further comprising a plurality of support arms, wherein each support arm is hingedly connected to a respective arm of the plurality of arms and each support arm is also hingedly connected to a respective column of the plurality of columns.

30. A method of moving a pipe stand from a well center to a storage rack comprising:

grabbing a pipe stand located at a well center with at least one grip;

rotating the pipe stand away from the well center towards the storage rack;

moving the pipe stand towards the storage rack by moving a dolly vertically along a column;

rotating the pipe stand towards the storage rack;

moving the pipe stand towards the storage rack by moving a carriage along a bridge;

securing the pipe stand within the storage rack; and releasing the at least one grip.

31. The method of claim 30, further comprising the step of lifting the pipe stand at the well center using a vertical lift column.

32. The method of 31, further comprising the step of lowering the pipe stand at the storage rack using the vertical lift column.

33. The method of claim 30, wherein a hydraulic cylinder is used open and close the at least one grip.

34. The method of claim 30, wherein the column is attached to a mast of a rig.

35. The method of claim 34, further comprising the step of controlling the movement of the pipe stand at a control panel located on a platform on the rig.

36. The method of claim 30, wherein the storage rack is a fingerboard.

37. The method of claim 36, further comprising securing at least one pipe stand in the fingerboard by actuating a locking mechanism between the fingers of the fingerboard where the pipe stand is stored.

38. An apparatus for moving a pipe stand, the apparatus comprising:

at least one dolly, wherein the at least one dolly is adapted to travel vertically along a mast;

a bridge, the bridge being hingedly connected to the at least one dolly, wherein the movement of the at least one dolly in one direction along the mast moves the bridge away from the mast and the movement of the at least one dolly in the other direction along the mast moves the bridge towards the mast;

a carriage, the carriage adapted to travel horizontally along the bridge;

a vertical lift column, the vertical lift column connected to the carriage;

a boom having at least one grip adapted to hold a pipe stand, the boom being connected to the vertical lift column;

wherein the vertical lift column vertically raises or lowers the boom with respect to the bridge; and wherein the boom may rotate about a vertical axis.

* * * * *